US007657951B2

(12) United States Patent
Tally

(10) Patent No.: US 7,657,951 B2
(45) **Date of Patent: *Feb. 9, 2010**

(54) SUPPORT AND TRANSFER APPARATUS FOR TRANSPORT OF AN INCAPACITATED INDIVIDUAL

(75) Inventor: Kevin L. Tally, Clarinda, IA (US)

(73) Assignee: EZ Way, Inc., Clarinda, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/151,760

(22) Filed: Jun. 14, 2005

(65) Prior Publication Data

US 2005/0273927 A1 Dec. 15, 2005

Related U.S. Application Data

(60) Provisional application No. 60/579,475, filed on Jun. 14, 2004, provisional application No. 60/654,690, filed on Feb. 18, 2005.

(51) Int. Cl.

| | |
|---|---|
| ***A61G 7/10*** | (2006.01) |
| *A61G 1/00* | (2006.01) |
| *A61G 5/00* | (2006.01) |
| *A61G 7/053* | (2006.01) |

(52) U.S. Cl. ..... 5/86.1; 5/87.1; 5/83.1; 5/89.1; 5/81.1 R

(58) Field of Classification Search ..... 5/81.1 R, 5/83.1, 85.1, 87.1, 89.1; 212/901, 203, 343; 254/9 B, 10 B, 8 B, 8 R
See application file for complete search history.

(56) References Cited

U.S. PATENT DOCUMENTS

| | | | | |
|---|---|---|---|---|
| 2,990,899 | A | 7/1961 | De Bella | |
| 3,263,822 | A * | 8/1966 | Weinman | 212/301 |
| 3,338,323 | A | 8/1967 | Swersey | |
| 3,424,134 | A * | 1/1969 | Rosenblum | 182/3 |
| 3,521,860 | A * | 7/1970 | Zehrung, Jr. et al. | 254/8 R |
| 3,711,877 | A * | 1/1973 | Averill | 5/87.1 |
| 3,998,264 | A | 12/1976 | James | |
| 4,482,783 | A | 11/1984 | Laimins | |
| 4,799,562 | A | 1/1989 | Burrows et al. | |
| 4,875,555 | A | 10/1989 | Johansson et al. | |
| 4,926,951 | A | 5/1990 | Carruth et al. | |
| 5,022,106 | A | 6/1991 | Richards | |
| 5,033,563 | A | 7/1991 | Brainerd et al. | |
| 5,174,399 | A | 12/1992 | Braunels | |
| 5,185,895 | A | 2/1993 | Gagne et al. | |
| 5,365,621 | A | 11/1994 | Blain | |
| 5,379,468 | A * | 1/1995 | Cassidy et al. | 5/86.1 |
| 5,406,658 | A | 4/1995 | Olkkonen et al. | |
| 5,459,891 | A | 10/1995 | Reeve et al. | |
| 5,649,329 | A | 7/1997 | Horcher et al. | |
| 5,692,253 | A | 12/1997 | Keijser et al. | |
| 5,784,729 | A | 7/1998 | Dunn et al. | |
| 5,878,450 | A | 3/1999 | Bouhuljs | |

(Continued)

*Primary Examiner*—Darnell Jayne
*Assistant Examiner*—Jonathan J Liu
(74) *Attorney, Agent, or Firm*—Banner & Witcoff, Ltd.

(57) ABSTRACT

A patient transport apparatus includes a sling for movement of a person from or into a vehicle seat supported by a dual legged horizontal frame mounted on rollers or wheels with a generally vertical, telescoping post having a cantilever arm extending therefrom. A cable or strap supported by the cantilever arm is attached to the adjustable body sling which designed to securely hold a patient during transport.

12 Claims, 6 Drawing Sheets

U.S. PATENT DOCUMENTS

| | | | |
|---|---|---|---|
| 5,892,180 | A | 4/1999 | Carey |
| 5,987,664 | A | 11/1999 | Somerton et al. |
| 6,047,418 | A | 4/2000 | Selde et al. |
| 6,161,232 | A | 12/2000 | Von Schroeter et al. |
| 6,201,195 | B1 | 3/2001 | Carey |
| 6,289,534 | B1 | 9/2001 | Hakamiun et al. |
| 6,329,612 | B1 | 12/2001 | Von Schroeter |
| 6,367,103 | B1 | 4/2002 | Collins |
| 6,694,545 | B1 | 2/2004 | Renton |
| 6,806,430 | B2 | 10/2004 | Downing |
| 2004/0064886 | A1 | 4/2004 | Alverson et al. |

* cited by examiner

SUPPORT AND TRANSFER APPARATUS FOR TRANSPORT OF AN INCAPACITATED INDIVIDUAL

CROSS REFERENCE TO RELATED APPLICATIONS

This is a utility application based upon, derived from, incorporating by reference and claiming priority to prior U.S. provisional application Ser. No. 60,579,475 filed Jun. 14, 2004 and U.S. provisional application Ser. No. 60/654,690 filed Feb. 18, 2005, each of which is entitled Support and Transfer Apparatus for Transport of an Incapacitated Individual.

BACKGROUND OF THE INVENTION

In a principal aspect, the present invention relates to a transport device especially useful for transport of an incapacitated individual, for example, by removal from or seating in a vehicle.

In order to avoid manual lifting of incapacitated individuals, such as hospital or health care patients, various types of lifts or supports for such patients have been proposed. For example, in U.S. Pat. No. 6,806,430 there is disclosed a patient lift device which comprises a framework including spaced, projecting horizontal legs connected by a frame cross member that supports a vertical post and lift mechanism upon which a patient chair, harness or sling assembly is situated. A patient in the chair, harness or sling assembly may be raised and lowered and moved by virtue of the lift construction. Thus, the patent discloses a lifting system for patients particularly in the health care field.

A problem which remains continuously vexing, however, is movement of a patient from a vehicle or into a vehicle utilizing a patient assist system. The dimensions of vehicles vary significantly. The height of the space or area within the passenger compartment of vehicles varies significantly. Thus, there has developed a problem of determining methodologies and providing apparatus which will facilitate movement of patients into and out of vehicles as well as into and out of other environments and further which permits ease of and safety of carrying or movement of a patient and reducing the possibility of injury to a health worker attempting to lift or move the patient.

SUMMARY OF THE INVENTION

In a principal aspect, the present invention comprises various embodiments of apparatus for transport of a person, in a generally seated position supported in a sling, into and out of a motor vehicle. The apparatus generally includes first and second horizontal, spaced legs connected by a cross frame member. The legs each include wheels which may be locked to prevent rolling of the assembly or apparatus once it is desirably positioned and unlocked to permit movement of the apparatus and patient. The cross frame member supports a generally vertical post or support element located between the horizontal legs. In one embodiment, the upwardly extending support post or element is adjustably attached to the cross frame member to enable location of the post at various distinct positions between the legs. The vertical support element is optionally a telescoping member.

A boom extends transversely from the upper end of the generally vertical support element or post. A patient support strap is incorporated in the boom. The support strap is connectable to a patient sling assembly. The boom is optionally a telescoping boom. Mechanisms are incorporated to telescope the vertical support post and/or boom and to control the release or take-up of the patient support strap and patient in a sling.

Thus, it is an object of the invention to provide a patient transport assembly which includes a patient support sling adjustably suspended from a generally horizontal boom.

Another object is to provide a patient transport assembly which includes a vertical support post that may telescope and which may be adjusted laterally between the opposite sides of a support base or frame.

Another object of the invention is to provide an easily and highly adjustable patient support and transport apparatus.

A further object of the invention is to provide a patient support and transport device which is reasonably priced, rugged and which is capable of supporting and transporting a wide spectrum of patient body sizes and weights and thus which is highly adjustable.

These and other objects, advantages and features will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Referring to the figures, the patient transport and support apparatus of the invention is designed to facilitate removal of a person from a first seated position or place, transport of that person and subsequent placement of that person in a second seated position or place. The device is especially useful for placement in or removal of a person from a motor vehicle wherein the roof of a vehicle may interfere with movement or the position of a person within the vehicle. The apparatus or device is also especially useful inasmuch as it is a mechanical device which enables lifting and movement of an individual solely by means of the apparatus thereby, reducing or eliminating the possibility of back strain typically associated with such movement when effected by health workers seeking to physically lift and transport a patient.

Figure 1:
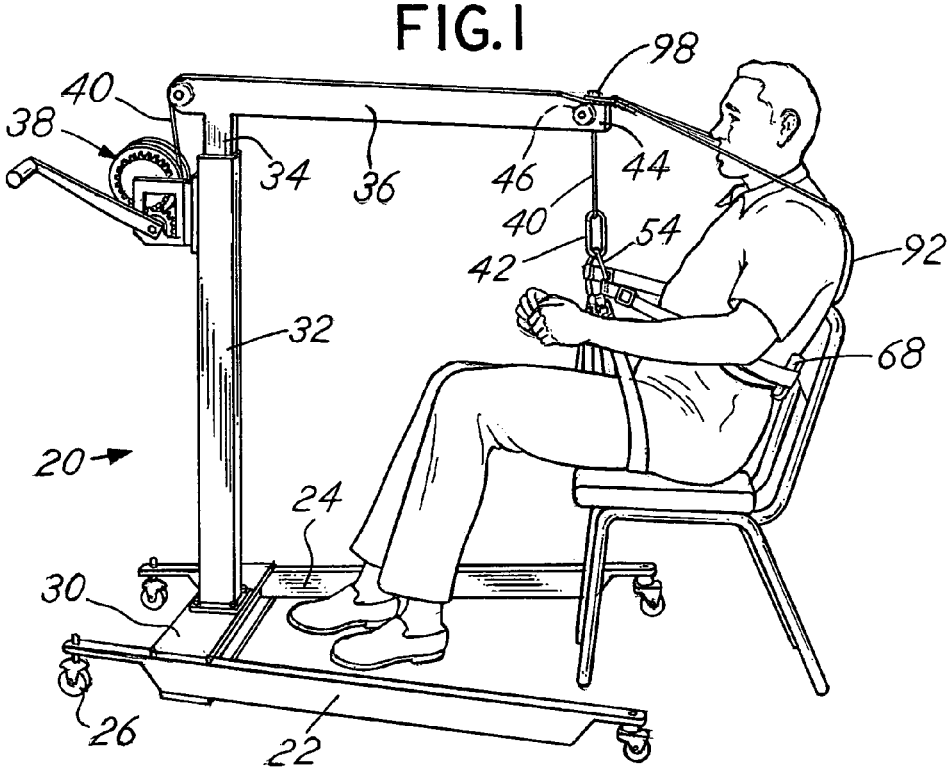
FIG. 1 is an isometric view of the improved apparatus of the invention employed to move an incapacitated individual from a seated position.
Figure 2:
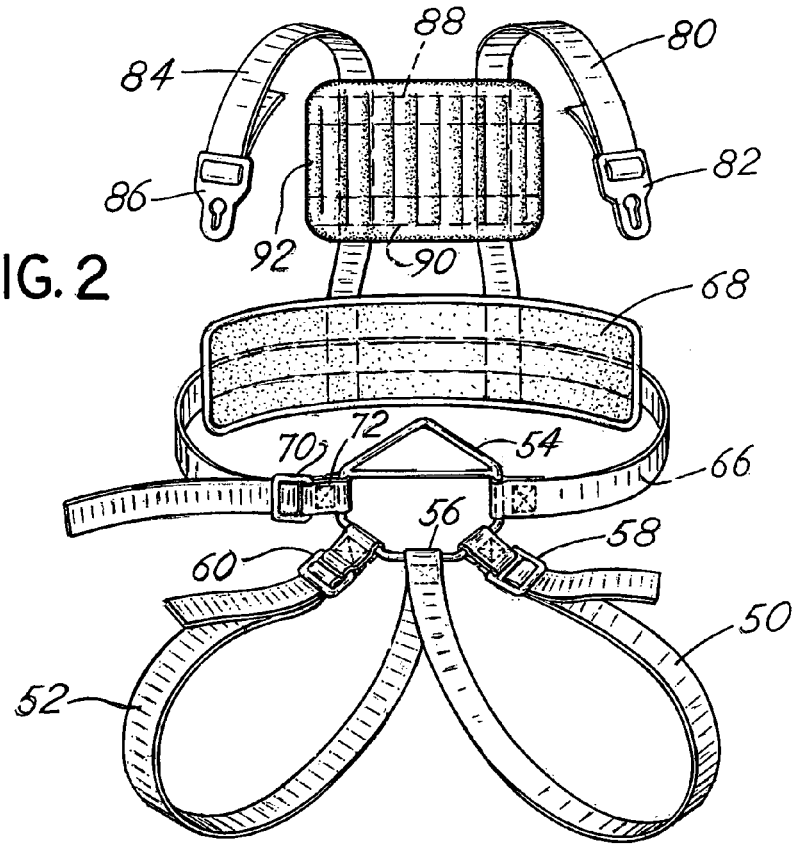
FIG. 2 is an isometric view of the sling construction associated with the apparatus of the invention.

Referring to FIGS. 1 and 2, the first embodiment of the invention depicted includes a cantilever arm support mechanism 20. The cantilever support mechanism 20 typically includes generally horizontal, spaced lower support legs 22 and 24 which are mounted on rollers, such as rollers 26. The rollers 26 may include a locking mechanism which may lock the wheels or rollers 26 to maintain the cantilever arm support mechanism 20 in a fixed position or location. A transverse, horizontal cross member 30 connects legs 22 and 24 generally adjacent one end of legs 22, 24 opposite the direction of extension of a horizontal boom or support arm 36. A vertical support post 32 is mounted thereon generally midway between legs 22, 24. Post 32 may comprise a telescoping assembly including a generally vertical telescoping arm or post 34 which is connected to a generally horizontal support arm 36 or cantilever boom. The vertical arm 34 is telescopically inserted into the arm, post or tube 32. Preferably, the cross sectional shape of the arms 32 and 34 is polygonal so that the arms 32, 34 will not rotate undesirably with respect to each other. However, it is possible to mount the arm 32, for example, on a rotational base plate or connection to the cross member 30 so as to provide for a desired ability to rotate the horizontal arm 36 about the vertical axis of vertical arms 32, 34. Generally, however, the cantilever boom 36 is parallel to and extends in the direction of legs 22, 24 to facilitate balance of the apparatus. Thus, the arms 32, 34 are keyed to preclude rotation and rigidly mounted on cross frame member 30. Preferably, the entire mechanism 20 is rotated or moved on the rollers 26 in order to maintain appropriate balance of an individual carried by the mechanism or apparatus 20.

In the disclosed embodiment, a winch mechanism 38 is attached to post 32. Winch mechanism 38 is connected to a strap or cable 40 that runs along the interior of the horizontal arm 36 and connects with an end or a clip 42 for cooperation with a sling that is attached to and supports a patient or person. A hand operated winch 38 is depicted; however, electrically operated winches may also be utilized.

The cantilever arm 36 includes an outer end 44 with a pulley 46 for the strap or cable 40 to fit over. The cantilever arm 36 is of a length adequate to extend, for example, into the doorway of a motor vehicle so as to enable it to be positioned over a person and, in particular, the torso of an individual positioned within an automobile or on a chair, for example. Arm 36 may be a telescoping assembly.

The person or patient is typically supported by a sling suspended from the clip 42 at the end of cable 40 as depicted, for example, in FIG. 1. The sling construction is illustrated in greater detail in FIG. 2.

Referring to FIG. 2, the sling construction includes a first flexible strap 50 which defines a left leg support strap and a second flexible strap 52 which defines a right leg support strap. Each of the straps 50 and 52 is connected to the center of a ring element 54. Thus, the first leg loop strap 50 is attached at a first end to the leg loop ring 54 at the center of the ring 54 as depicted in FIG. 2; namely, at the center section 56. The opposite end of the adjustable length strap 50 is attached by a buckle 58 adjacent the connection 56 to the ring 54. Similarly, the right hand leg strap 52 which is adjustable, is attached by means of a buckle and attachment strap mechanism 60 adjacent the center attachment 56.

The sling assembly further includes a waist strap which comprises a flexible strap member 66 connected from one side of the ring 54 through a back support pad 68 to a buckle 70 which, in turn, attaches to a strap connection 72 connected to the opposite side of the ring 54. A left hand shoulder strap 80 extends from the waist strap 66 and includes a buckle element 82 at the distal end thereof. A right hand adjustable length shoulder strap 84 includes a buckle element 86. Horizontal connecting straps 88 and 90 connect the shoulder straps 80 and 84 and space them apart one from the other so that a pad 92 supported by the straps 80 and 84 may be positioned against the back side of a patient just as the waist pad 68 may be so positioned. Choosing and adjusting the appropriate length of the various straps enables one to accommodate persons of various sizes. Thus, the spacing of the various straps can be accommodated or adjusted by means of the adjustable buckles described or the sling itself may be made in various sizes so as to accommodate persons of various size and stature.

The buckles 82 and 86 are designed to be hooked together, or to be engaged together, and attached to a clip 98 affixed to the end of a cantilever arm. Thus, the shoulder straps 80, 84 which are adjustable in length can be adjusted so as to accommodate the angle of inclination of a patient supported by the sling. Shoulder straps thus are attached to the ring or clip element 98 attached at the end of the arm. The patient may, therefore, be in any of multiple positions from a prone position to a seated position, for example.

The cable 40 is attached to a second clip 42 which attaches to the ring 54. In this manner, the ring 54 may be appropriately engaged and the cable 40 tightened so as to elevate the individual seated in a chair or seat from the chair or seat and to maintain that person at a fixed level. The chair, for example, as shown in FIG. 1, may then be removed from beneath the patient. The patient, who may be in a partially recumbent position leaning back against the shoulder straps, will be maintained in that position by means of the sling and, in particular, the leg straps and waist strap. The combination shoulder straps and pads will also facilitate maintaining the patient in a recumbent position leaning backward as shown in FIG. 1.

Use of the operating winch effectively lifts the leg straps and waist strap to elevate a patient slightly so that the patient may be elevated above a chair or seat. Thereafter, the apparatus with the telescoping arm 36 elevated may be moved on the rollers 26, for example, and the patient may then be transported in an appropriately elevated position into a motor vehicle for seating. When positioned in the motor vehicle, the patient, because of the flexibility of the various belts and the support mechanism, may be pivoted about the end of the arm 36. The winch 38 may then be reversed and the patient lowered into the seat of the vehicle. When so lowered, the various straps may be released and the patient may then be easily adjusted and situated in the motor vehicle.

The reverse of this operation may also be effected. That is, a patient or person may be in a vehicle and then attached to the sling. The person may then be slightly elevated from the seat of the vehicle and moved from the vehicle.

Figure 3:
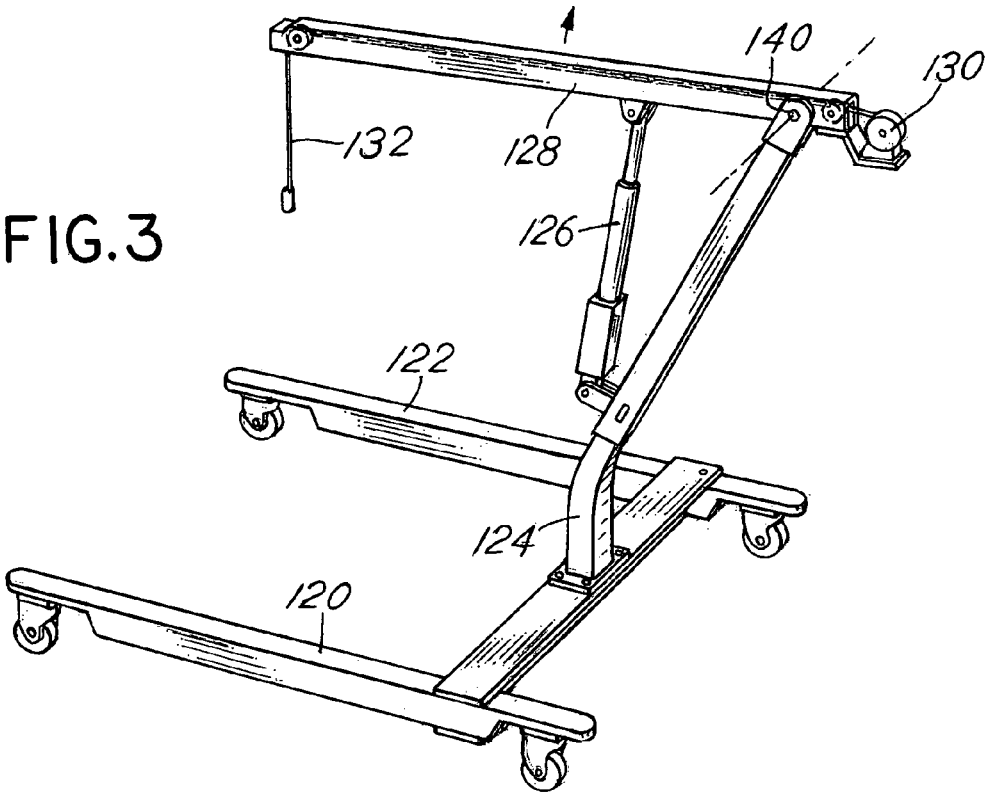
FIG. 3 is an isometric view of an alternative construction for a cantilever beam, patient support apparatus of the invention.
Figure 4:
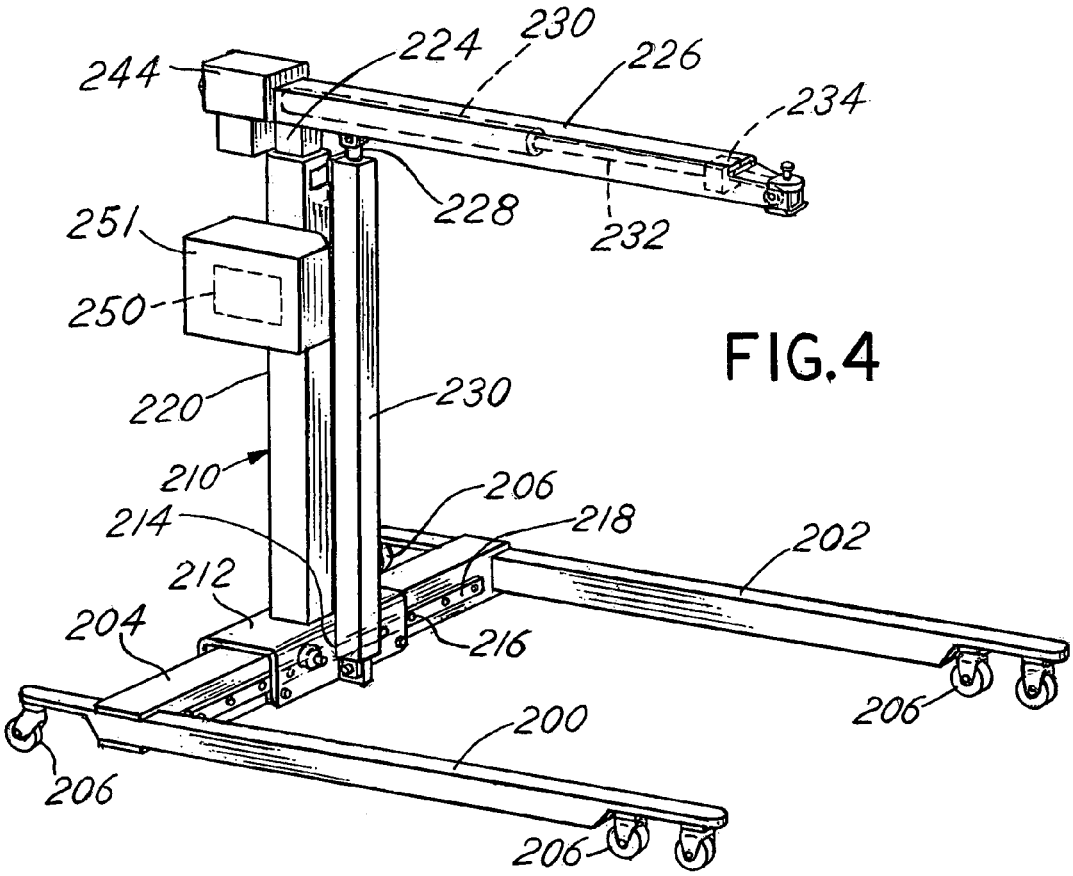
FIG. 4 is an isometric view of an alternative embodiment of a patient support apparatus.
Figure 5:
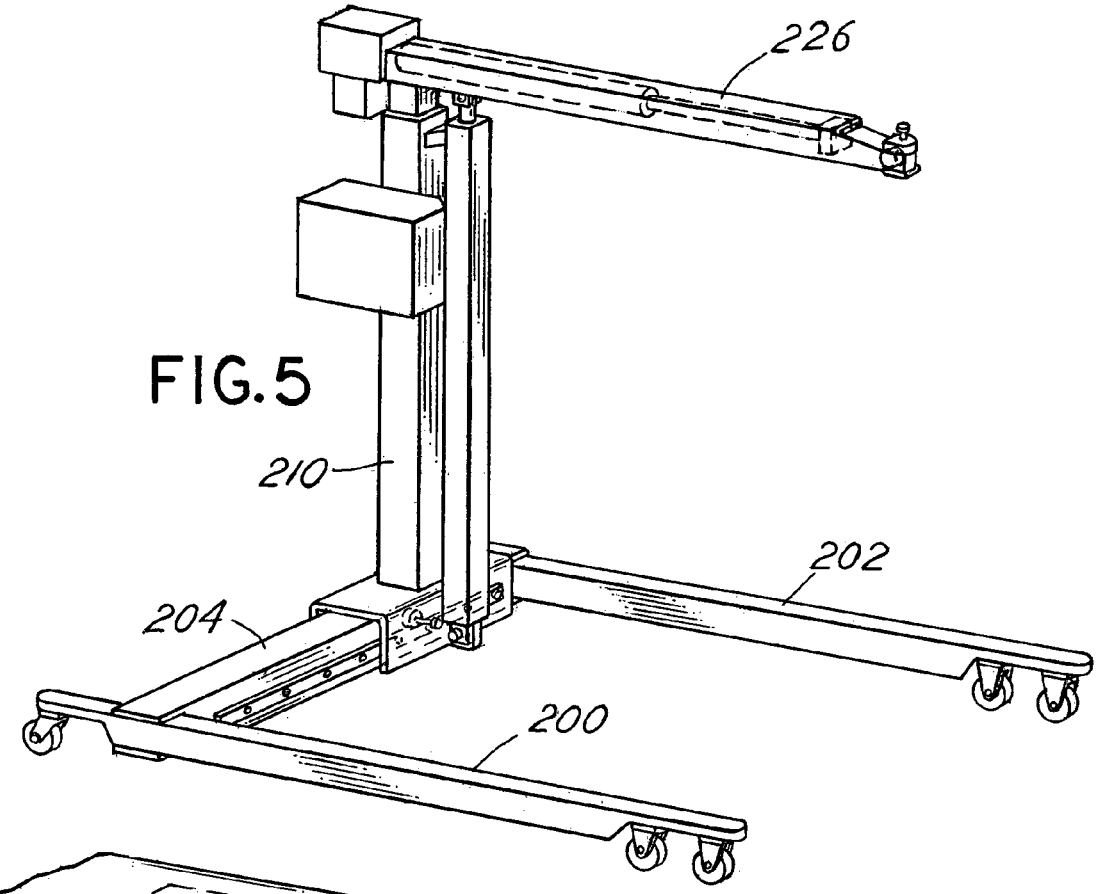
FIG. 5 is an isometric view of the apparatus of FIG. 4 wherein the intermediate, generally vertical support element is depicted as being moved laterally on a frame member with respect to the midpoint between generally spaced horizontal support legs.

FIG. 3 illustrates an alternative cantilever arm, patient support and movement mechanism. In FIG. 3 horizontal, base support legs 120 and 122 support a vertical or nearly vertical support arm 124. The nearly vertical support arm 124 has a linear actuator 126 attached to a pivoting boom or cantilever arm 128. This arrangement further includes a winch mechanism 130 associated with a cable or strap 132 similar to the mechanism previously described and depicted in FIG. 1, for example. With this particular mechanism as depicted in FIG. 3, the boom 128 may be pivoted about a horizontal axis 140 to effect raising and lowering of an individual. This arrangement may result in the elimination of a vertically telescoping arm or such a mechanism could be used in combination with a vertically telescoping arm.

FIGS. 4-10 illustrate another preferred embodiment of the invention. Thus, referring to the figures, the depicted patient lift and support device includes a first generally horizontal 200 and a second, spaced, generally horizontal ground support leg 202. The legs 200 and 202 are elongate, generally parallel or slightly diverging leg members spaced one from the other and connected adjacent one end to a cross frame member 204 joins the legs 200 and 202. Rollers or wheels 206 are affixed to the opposite ends of each leg member 200, 202.

The cross frame member 204 supports a vertical or generally vertical support element or post 210 which is affixed to the cross frame member 204 by a slidable bracket 212. The bracket 212 comprises a sleeve which fits over the frame member 204 and is slidable with respect thereto. A locking pin 214 is provided to engage a detent or opening such as opening 216 to thereby hold the vertical support element or member 210 in a fixed position intermediate the spaced legs 200 and 202. Thus, a series of openings such as opening 216 are provided along the longitudinal bar 218 mounted on frame member 204 to thereby provide incremental, detent locking positions for the vertical support element 210. The vertical support element 210 is comprised of a series of tubular telescoping members including an outer member 220 and telescoping slidably inserted inner members 224. A generally horizontally extending arm or boom 226 is affixed to the inner telescoping member 224. A piston actuated rod 228 associated with a cylinder 230 may be extended such as depicted, for example, in FIG. 6 to telescope the inner support members or element 224 and thus raise or lower the boom 226.

Figure 9:
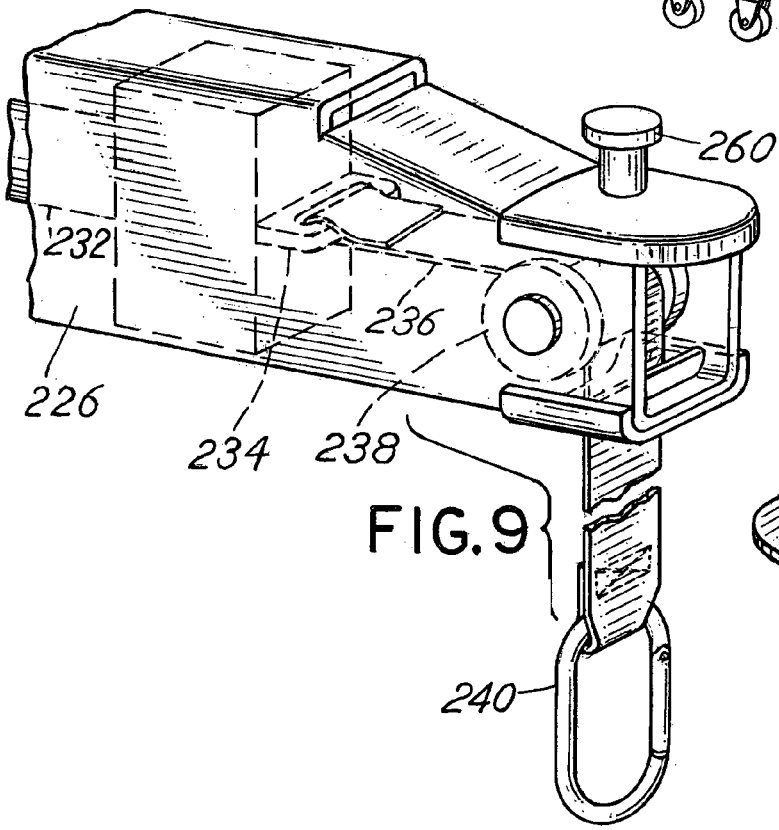
FIG. 9 is a partial isometric view of the strap support and adjustment mechanism associated with the boom of the patient lift and support apparatus of FIG. 4.
Figure 10:
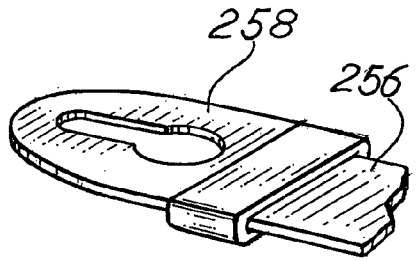
FIG. 10 is an enlarged isometric view of a belt construction which cooperates with the boom of the patient lift and support apparatus and the patient sling of FIG. 2.
Figure 6:
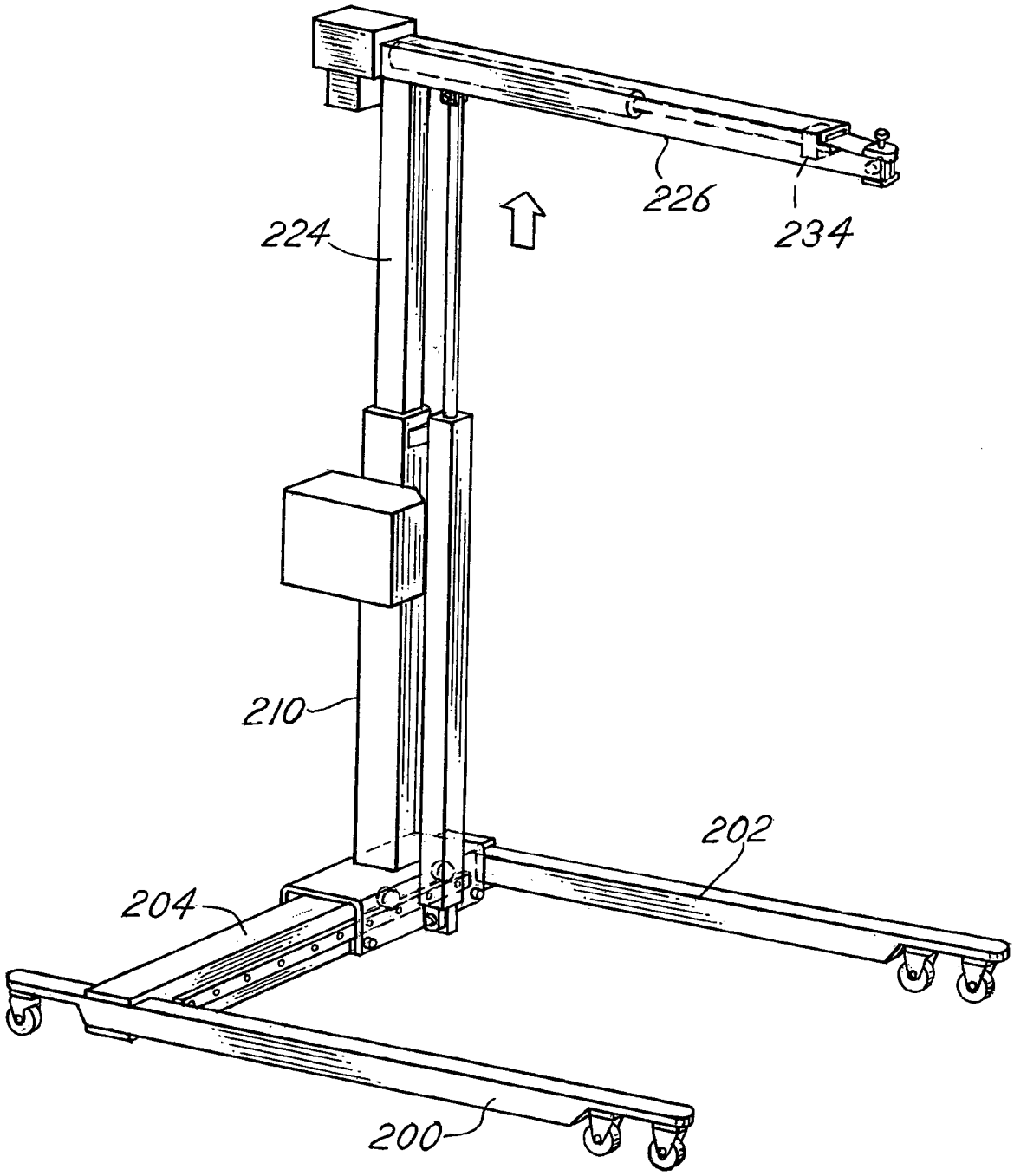
FIG. 6 is an isometric view illustrating the telescopic operation of the intermediate, generally vertical, support element or post.
Figure 7:
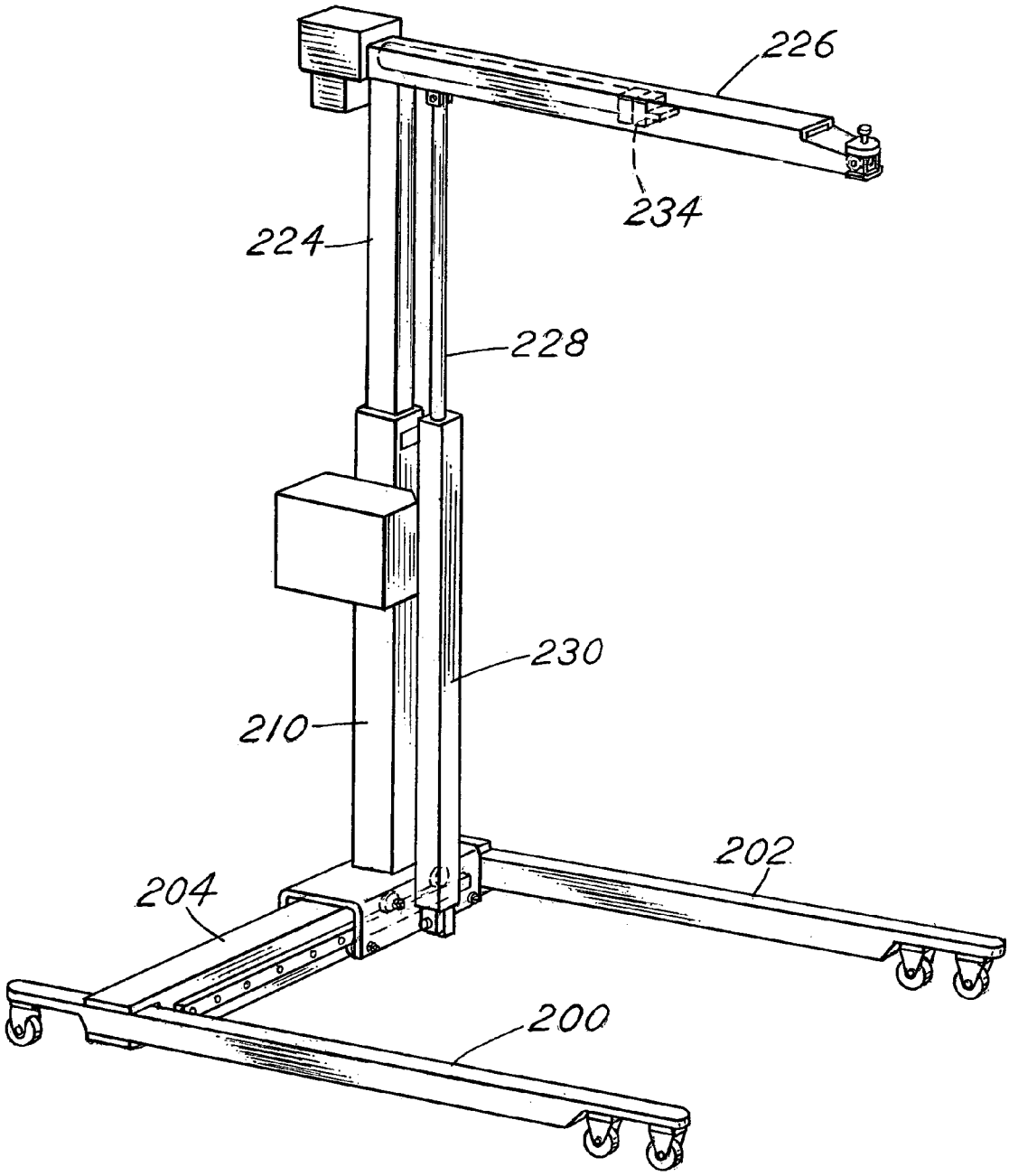
FIG. 7 is an isometric view similar to FIG. 6 wherein the mechanism which controls the extension of the flexible patient support strap is in a retracted position within the generally horizontal patient support boom.
Figure 8:
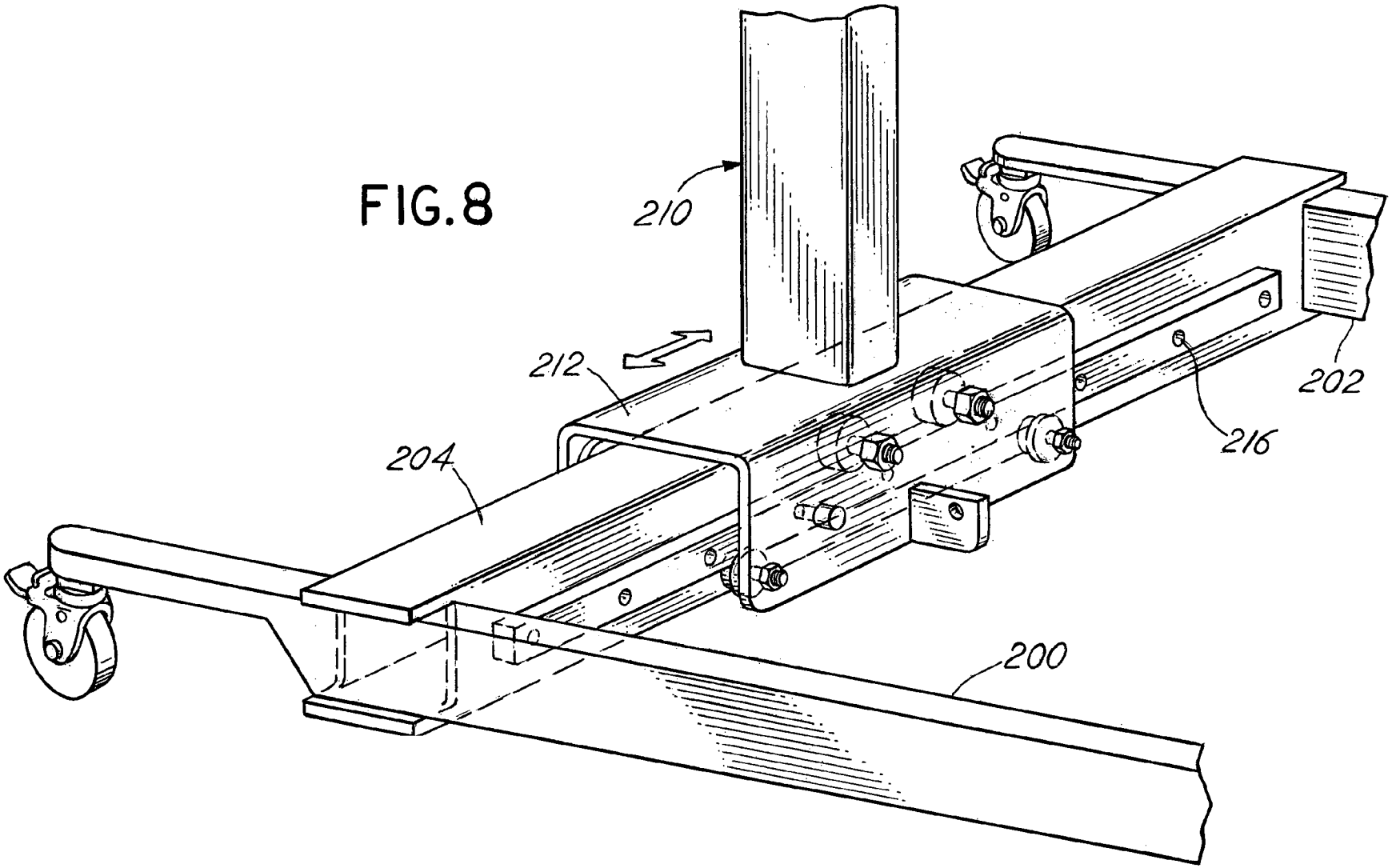
FIG. 8 is an enlarged isometric view illustrating the attachment mechanism for the generally vertical, intermediate support element or post to the cross frame member between the spaced horizontal legs of the patient lift or support apparatus of FIG. 4.

The boom 226 is a generally hollow member and includes a cylinder 230 retained therein with an extendable rod 232. The rod 232 is, at its distal end 234 as shown in FIG. 9, connected to a strap 236 that fits over a pulley or roller 238 mounted on the end of the boom 226. The strap 236 receives a carbiner 240 at its distal end. The rod 232 may be actuated in response to the control element 244 associated with the cylinder 230 to retract the end 234 of the rod 232 and thus raise the strap 236. Of course, movement of the rod 232 in the opposite direction will effect outward movement or release of the strap 236. Operation of the various pistons and cylinders associated with the movement of the support element 210 and the boom 226 may be controlled by a control mechanism 250 retained within a control box 251.

The carbiner 240 may be attached to various support straps for example, which support a patient such as depicted in FIG. 2. Additionally, the ends of separate support straps such as support strap 256 may include a fitting 258 which will fit onto a top post 260 attached to the end of the boom 226. Thus, patient support straps may be customized to support a patient in any one of a number of positions by cooperative engagement with the top post 260 and the carbiner 240. Vertical movement of the patient is effected by operation of the rod 232 and movement of the strap 236 upwardly and downwardly over the roller 238.

One of the benefits of the construction of the embodiment of FIGS. 4-10 is the fact that the support beam or support element 210 may be positioned laterally on the frame member 204 in a manner which enables the legs 202 and 200 to be placed under a vehicle relative to the door or exit from a vehicle in a manner that does not interfere with the position of the tires or running gear of the vehicle. In other words, custom adjustment of the support apparatus may be effected by the lateral adjustment of the support element 210 as well as the vertical raising of that support element 210. The boom 226 may also be telescoping. The strap 236 may be extended or withdrawn in response to piston actuation as described. The legs 200 and 202 may be telescoping and adjusted longitudinally with respect to the cross frame member 204 or outwardly from cross frame member 204. The wheels 206 may also include a locking mechanism which holds them in position. Thus, there are numerous variations of the construction of the invention which are considered to be within the scope thereof.

While there has been set forth preferred embodiments of the invention, it is to be understood that the invention is limited only by the following claims and equivalents thereof.

What is claimed is:

1. A patient extraction lift apparatus comprising, in combination:

(a) a first horizontally extending, elongate, cantilever ground support leg having a first connection end and a second opposite end spaced from the first end;

(b) a second generally horizontally extending, elongate, cantilever ground support leg having a first connection end and a second opposite end spaced from the first end of the second leg, said first and second legs generally parallel and spaced horizontally apart to define an interval;

(c) a cross member attached to the first connection ends of the first and second spaced ground support legs to form a generally three sided, generally horizontal ground support frame having said spaced first and second cantilever ground support legs extending generally horizontally outwardly from the cross member, said support legs each providing cantilever support for the lift apparatus, said first and second legs each including wheels attached to their respective connection end and opposite end;

(d) a slidable bracket fitted over and slidable on the cross member between the first and second legs, said bracket including a locking element for retaining the slidable bracket in a fixed position on the cross member;

(e) an upwardly extending patient support post having a shape configured for non-rotation thereof, said post fixed to the slidable bracket in the interval intermediate the elongate, cantilever support legs, said slidable bracket and fixed post slidably fitted to the frame cross member for simultaneous lateral movement along the cross member in the interval between the first and second spaced, ground support legs to enable positioning the fixed patient support post to the cross member at a plurality of positions intermediate the spaced legs;

(f) a generally horizontal boom non-rotatably fixed to and projecting from the fixed support post at a level elevated from the ground support legs, said boom having an outer end, said boom extending generally in the direction of the first connection ends toward the opposite ends of the cantilever legs, said post fixed to said bracket slidably mounted to said cross member and said boom is non-rotatably fixed to said post to maintain said boom extending in said direction of said cantilever legs and so that said post will not rotate; and (g) a patient support sling attached to the outer end of said boom for supporting a patient.

2. The apparatus of claim 1 wherein the upwardly extending support post is a vertically telescoping member.

3. The apparatus of claim 2 further including a telescoping drive mechanism for the telescoping member.

4. The apparatus of claim 1 wherein the cross member has a plurality of horizontal detent positions for engagement by the locking element.

5. The apparatus of claim 1 wherein the locking element includes an actuator mounted on the support for releasing the locking mechanism to permit movement of the support horizontally on the cross member.

6. The apparatus of claim 1 wherein said sling comprises;

a first under leg strap, including connectable opposite ends;

a second back support-strap having opposite ends connectable at a juncture to the under leg strap; and said straps connectable at said juncture.

7. The apparatus of claim 6 further including first and second shoulder straps, each shoulder strap extending from the back strap to a distal end attachable to the boom, said leg strap, back strap and shoulder straps forming a harness.

8. The apparatus of claim 7 further including a second under leg strap having connectable opposite ends, said second under leg strap also connectable to the juncture.

9. A patient extraction lift apparatus comprising, in combination:

(a) a first horizontally extending, elongate, cantilever ground support leg having a first connection end and a second opposite end spaced from the first end;

(b) a second generally horizontally extending, elongate, cantilever ground support leg having a first connection end and a second opposite end spaced from the first end of the second leg, said first and second legs generally parallel and spaced horizontally apart to define an interval;

(c) a cross member attached to the first connection ends of the first and second spaced ground support legs to form a generally three sided, generally horizontal ground support frame having said spaced first and second cantilever ground support legs extending generally horizontally outwardly from the cross member, said support legs each providing cantilever support for the lift apparatus, said first and second legs each including wheels attached to their respective connection end and opposite end;

(d) a slidable bracket fitted over and slidable on the cross member between the first and second legs, said bracket including a locking element for retaining the slidable bracket in a fixed position on the cross member;

(e) an upwardly extending, telescopically extendable patient support post having a shape configured for non-rotation thereof, said post non-rotatably fixed to the slidable bracket in the interval intermediate the elongate, cantilever support legs, said slidable bracket and fixed post slidably fitted to the frame cross member for simultaneous lateral movement along the cross member in the interval between the first and second spaced, ground support legs to enable positioning the fixed patient support post to the cross member at a plurality of positions intermediate the spaced legs;

(f) a generally horizontal boom projecting from and non-rotatably attached to the support post at a level elevated from the ground support legs, said boom having an outer end, said boom extending generally in the direction of the first connection ends toward the opposite ends of the cantilever legs, said post fixed to said bracket slidably mounted to said cross member and said boom mounted to said post to maintain said boom extending in said direction of said cantilever legs;

(g) a patient support sling attached to the outer end of said boom for supporting a patient;

(h) a telescoping drive mechanism for the telescoping post; and (i) a telescoping drive mechanism for the telescoping boom.

10. The apparatus of claim 9 wherein said sling comprises;

a first under leg strap, including connectable opposite ends;

a second back support strap having opposite ends connectable at a juncture to the under leg strap; and said straps connectable at said juncture.

11. A patient extraction lift apparatus comprising, in combination:

(a) a first horizontally extending, elongate, cantilever ground support leg having a first connection end and a second opposite end spaced from the first end;

(b) a second generally horizontally extending, elongate, cantilever ground support leg having a first connection end and a second opposite end spaced from the first end of the second leg, said first and second legs generally parallel and spaced horizontally apart to define an interval;

(c) a cross member attached to the first connection ends of the first and second spaced ground support legs to form a generally three sided, generally horizontal ground support frame having said spaced first and second cantilever ground support legs extending generally horizontally outwardly from the cross member, said support legs each providing cantilever support for the lift apparatus, said first and second legs each including wheels attached to their respective connection end and opposite end;

(d) a slidable bracket fitted over and slidable on the cross member between the first and second legs, said bracket including a locking element for retaining the slidable bracket in a fixed position on the cross member;

(e) an upwardly extending, telescoping patient support post having a shape configured for non-rotation thereof, said post fixed to the slidable bracket in the interval intermediate the elongate, cantilever support legs, said slidable bracket and fixed post slidably fitted to the frame cross member for simultaneous lateral movement along the cross member in the interval between the first and second spaced, ground support legs to enable positioning the fixed patient support post at a plurality of positions intermediate the spaced legs to the cross member;

(f) a generally horizontal support boom projecting from and non-rotatably attached to the fixed support post at a level elevated above the ground support legs, said telescoping boom having an outer end, said post fixed to said bracket slidably mounted to said cross member and said boom extending generally in the direction of the first connection ends toward the opposite ends of the cantilever legs, said post and boom being mounted on the slidable bracket so that the post will not rotate; and (g) a patient support sling attached to the outer end of the support boom for supporting a patient.

12. The apparatus of claim 11 wherein said sling comprises;

a first under leg strap, including connectable opposite ends;

a second back support strap having opposite ends connectable at a juncture to the under leg strap; and said straps connectable at said juncture.

* * * * *